US005655232A

United States Patent [19]

Buckwalter

[11] Patent Number: 5,655,232

[45] Date of Patent: Aug. 12, 1997

[54] FLUID LEVEL CONTROL DEVICE AND METHOD

[76] Inventor: James K. Buckwalter, 140 Indian Bayou Dr., Destin, Fla. 32541-4415

[21] Appl. No.: 475,012

[22] Filed: Jun. 7, 1995

[51] Int. Cl.[6] ..... E04H 4/12

[52] U.S. Cl. ..... 4/508; 137/449; 137/403; 137/434

[58] Field of Search ..... 4/507, 508; 137/428, 137/449, 433, 410, 424, 425, 429, 442, 512, 516.25, 522, 523, 533.11, 404, 403, 434

[56] References Cited

U.S. PATENT DOCUMENTS

| | | | |
|---|---|---|---|
| 513,474 | 1/1894 | Bate | 137/404 |
| 2,206,996 | 7/1940 | Asselin | 137/425 |
| 2,627,868 | 2/1953 | Runnels | 137/433 |
| 2,739,939 | 3/1956 | Leslie . | |
| 2,756,769 | 7/1956 | Martin et al. | 137/449 |
| 2,809,752 | 10/1957 | Leslie | 210/127 |
| 3,386,107 | 6/1968 | Whitten, Jr. | 4/508 |
| 3,495,803 | 2/1970 | Schoepe et al. | 137/414 |
| 3,669,139 | 6/1972 | Gajdos | 137/317 |
| 3,739,405 | 6/1973 | Schmidt | 4/172.15 |
| 3,895,402 | 7/1975 | Page | 4/172.17 |
| 3,908,206 | 9/1975 | Grewing | 4/172.17 |
| 3,997,925 | 12/1976 | Hough | 4/172.17 |
| 4,185,333 | 1/1980 | Ortega | 4/172.15 |
| 4,186,765 | 2/1980 | Anderson | 137/414 |
| 4,265,598 | 5/1981 | Brand | 417/40 |
| 4,327,941 | 5/1982 | Schoepe | 285/23 |
| 4,342,125 | 8/1982 | Hodge | 4/508 |
| 4,373,220 | 2/1983 | Selsted | 4/508 |
| 4,462,417 | 7/1984 | Trinkwalder, Jr. | 137/449 |
| 4,574,405 | 3/1986 | Tams | 4/508 |
| 4,586,532 | 5/1986 | Tsolkas | 137/426 |
| 4,592,098 | 6/1986 | Magnes | 4/508 |
| 4,621,657 | 11/1986 | St. Ledger | 137/426 |
| 4,686,718 | 8/1987 | Kinkead et al. | 4/508 |
| 4,735,230 | 4/1988 | Detloff | 137/315 |

FOREIGN PATENT DOCUMENTS

| | | |
|---|---|---|
| 333291 | 4/1930 | United Kingdom . |

*Primary Examiner*—Henry J. Recla
*Assistant Examiner*—Charles R. Eloshway
*Attorney, Agent, or Firm*—Allen, Dyer, Doppelt, Milbrath & Gilchrist, P.A.

[57] ABSTRACT

A water level control device has connected tubular housings, one serving as a support for a hose connection and the other serving to house a float assembly for operation of a ball valve within the valve housing. An airtight float serves to raise the one extreme of a lever arm when buoyed by sufficient water level admitted through apertures in the float housing. The other extreme of the lever arm includes an upward projection that contacts a ball within the ball valve cavity urged against a lower valve seat by water pressure from a water hose. When the water level in the pool, and thus the float, is lowered, the one lever arm extreme will also be lowered raising the other extreme to cause the projection to lift the ball away from the valve seat and permit water from the hose to enter the pool. A water flooded ballast attached to the float provides a dampening effect so that the ballast and apertured float housing serve to dampen float motion due to surface waves. The valve ball has free movement within the valve cavity such that siphoning from the pool to the water supply is eliminated when the freely positioned ball is seated against the valve inlet thus stopping siphoning action. The device is provided for easy placement into a pool by suspension of the float housing and attached valve housing from an outrigger water supply assembly resting on a pool deck adjacent the pool.

16 Claims, 4 Drawing Sheets

FLUID LEVEL CONTROL DEVICE AND METHOD

BACKGROUND OF INVENTION

1. Field of Invention

The present invention relates generally to fluid level control, and more particularly to maintaining a desired water level in a swimming pool.

2. Background Art

Swimming pool owners know how important it is to maintain the correct level of water in a swimming pool, so that the skimmer has sufficient water flow to keep the circulation pump from running dry and resulting in pump and motor failure. It is possible to draw water from the bottom drain of the pool. However, to do so, the skimmer is bypassed, and floating trash blown into the pool will not be collected. If the floating trash is permitted to remain in the pool, much of it will eventually sink to the bottom and much of this trash will be sucked up from the bottom drain only to be deposited in the small collecting basket in the circulation pump. The basket in turn will eventually clog, and the result to the pump and pump motor will be the same as if the skimmer was without water flow. In addition, the pool clean-up job, if only the bottom drain is used, would become difficult.

There are several factors that cause the water level in the pool to drop below that necessary for the proper use of the skimmer and circulating pump. Water evaporates from sun and wind. Water is splashed out of the pool by active pool users. A slow leak occurs in the pool itself. It is therefore important to be able to maintain the water level within the pool, typically within plus or minus an inch, for proper functioning of the skimmer. Pool owners who are away from home for more than a few days at a time must depend on neighbors and friends to check on the water level of their pool. Each day, water must be added as necessary to keep the proper circulation through the skimmer and to avoid pump and motor breakdown. The peace of mind acquired by the use of a device to maintain a constant pool level is a well-known need in the industry. There are many devices available to the pool owner. Some are intended for industrial use and not specifically designed for swimming pool use, where wave action is often present. Of those intended for swimming pool use, most are expensive and are intended to be installed when the pool is being built.

U.S. Pat. No. 4,586,532 to Tsolkas discloses a liquid level actuator for sensing changes in liquid levels in a pool and adjusting the flow of the liquid into the pool to maintain the level at a selected height. The apparatus disclosed includes a base member, a liquid conduit mounted on the base member, an arm hingedly mounted on the base member proximate a delivery end of the conduit, a stopper fixed to the arm and arcuately moveable into and out of engagement with the conduit delivery end. A flotation body is fixed to a free end of the arm and adapted to be engaged by the liquid in the pool and buoyed at a level representative of pool level. Wave activity at the pool water surface causes the float to oscillate causing rapid fluctuations of water supplied to the pool. Such rapid fluctuations cause rapid on and off action to the water supply, which ultimately results in damaged supply conduit or source. U.S. Pat. No. 3,908,206 to Grewing discloses an automatic water level keeper for swimming pools that is located adjacent an upper rim of an above-ground swimming pool. The water levels in the pool and in a water tank of the device are equalized and a water supply line is connected to a float valve in the tank for providing make-up water for the swimming pool when the water level in the pool falls below a predetermined height of the water level in the tank. Such a structure is not easily adaptable for use in an in-ground pool and is typically installed as a permanent device. U.S. Pat. No. 4,574,405 to Tams discloses a water level control device adapted to be detachably mounted within a swimming pool at a desired water level. A float-controlled valve is mounted within a housing, wherein the float is responsive to changes in water level of the swimming pool. A water inlet and outlet are located outside of the housing, so as to prevent turbulence within the housing. U.S. Pat. No. 4,592,098 to Magnes for a liquid level control system includes a primary float valve, which allows liquid to flow into a pool reservoir when the level of the fluid in the reservoir is below a first predetermined level, and a secondary float valve associated with the primary flow valve, which shuts off the flow of fluid into the pool reservoir when the level of the liquid in the pool reservoir exceeds a second predetermined level which is higher in elevation than the first predetermined level. In operation, if the expected operation of the primary valve is prevented for any reason and the primary valve sticks or remains in an open condition allowing the liquid in the reservoir to reach a second predetermined level, the secondary valve terminates the flow of liquid from the source into the flow chamber.

The devices disclosed, and in many of the devices available, positive action to prevent siphoning from the pool into the water supply system is not taken. Further, many of the devices available lend themselves well to permanent installation of below-ground pools, but fall short of providing an easy and inexpensive portable system for use with such an in-ground pool.

SUMMARY OF INVENTION

It is an object of the invention to provide a device an method for automatically adding water to a swimming pool and the like when the water level has dropped below a desired level. It is yet another object to provide such a device with an anti-siphoning capability for preventing pool water from siphoning into the supply water system. It is further an object of the invention to provide a device without the need for fastening to pool structures while providing the device having low cost, low installation requirements and low maintenance. Another object is to provide a portable device that can be used with a standard garden hose and house outdoor spigot for a source a water. It is an object to maintain the device at its operating position within the pool through pool water turbulence. Further, it is an object of the invention to provide a device that avoids frequent on-off cycles due to wave action within the pool. It is yet another object of the invention to provide a device that is easily installed pool side.

The water level control device of the present invention comprises a valve body having a chamber defined by inlet and outlet end walls and valve body side walls. The end walls each have an aperture for fluid communication through the chamber. The valve body inlet end is dimensioned for communicating with a fluid source conduit for delivering fluid under pressure through the inlet aperture and into the chamber. A valve element is freely positioned for movement within the chamber. The valve element has a first position wherein fluid pressure from fluid passing into the chamber through the inlet aperture biases the element against the outlet aperture, the element forming a seal against the outlet aperture for preventing fluid from passing through the outlet aperture. The valve element has a second position wherein the element is displaced a distance away from the outlet aperture, unseated, sufficiently for providing fluid flow through the chamber from fluid under pressure entering the inlet aperture, flowing past the element and through the outlet aperture for filling a reservoir in fluid communication with a fluid source through the valve. In addition, the element has a third position wherein the element is biased against the inlet aperture in response to a reverse fluid flow into the chamber through the outlet aperture toward the inlet aperture. The element biases (seats) against the inlet aperture for preventing reverse flow (siphoning) through the valve chamber into the fluid source. Means for displacing the valve element from its first position to its second position provides an opposing bias to the element sufficient to overcome the fluid source pressure bias holding the element in the first position. The displacing means is responsive to a fluid level below a desired level thus permitting fluid to flow from the communicating fluid source through the valve to a reservoir having the fluid level.

In the preferred embodiment, the displacing means comprises a lever arm having distal and proximate ends separated by a fulcrum pin for pivoting the lever arm about the fulcrum pin. A valve pin is attached to the lever arm distal end for movement into the valve chamber through the valve body end wall outlet aperture. The valve pin has a length sufficient for displacing the valve element away from contact with the outlet aperture. A float is connected to the lever arm proximal end and is responsive to level changes within the reservoir wherein a fluid level below the desired level causes the float to lower thereby raising the valve pin and thus displace the valve element from the first to the second position. Further, in the preferred embodiment, a hollow ballast vessel having a chamber for holding water therein is attached to the float for movement coincident the float. The ballast vessel is submerged below the float. The ballast vessel provides a dampening of float oscillations resulting from wave action on the pool water surface proximate the float.

Further, the preferred embodiment for portable use comprises an outrigger assembly for maintaining float movement within a generally vertical direction and initially setting the float a desired level within the pool. The outrigger assembly has a vertical tubular portion having a length positioning the float for buoying the float at the desired pool water level. The outrigger assembly further has a horizontal tubular portion for placement on a pool deck adjacent the pool. The horizontal portion has one end adapted for fluid communication with a garden hose and forms a right angle with the vertical portion at a second end. The outrigger assembly further has a support member extending from the horizontal portion for holding the vertical portion and thus the float for movement in a generally vertical direction during operation.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

Figure 1:
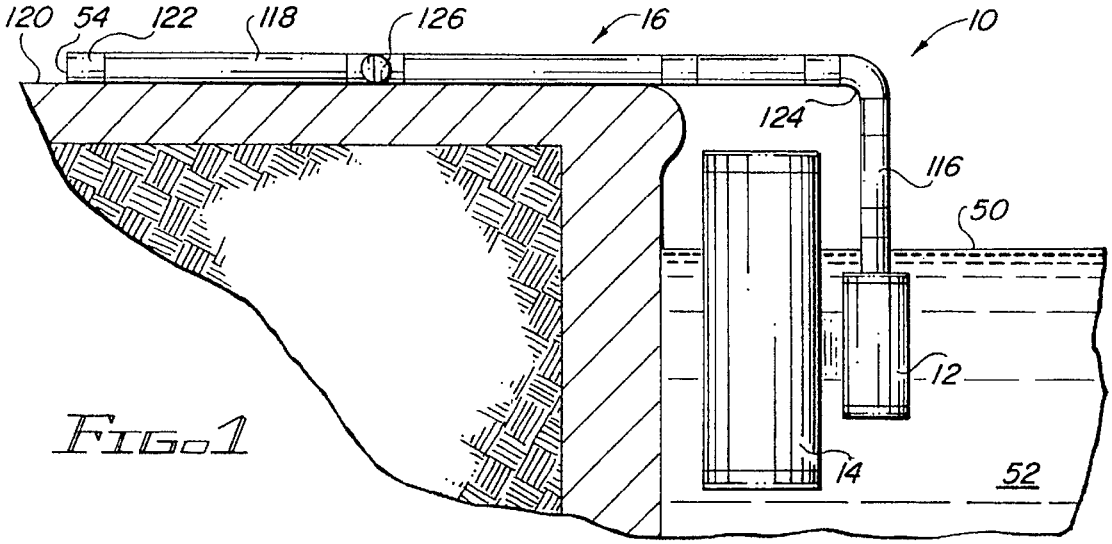
FIG. 1 is a partial side elevation view of a water level control device of the preferred embodiment.
Figure 2:
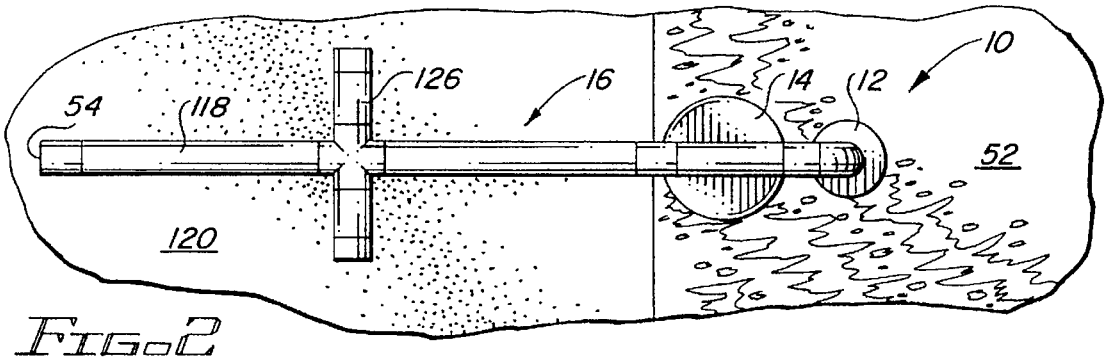
FIG. 2 is a top plan view of the embodiment of FIG. 1.
Figure 3:
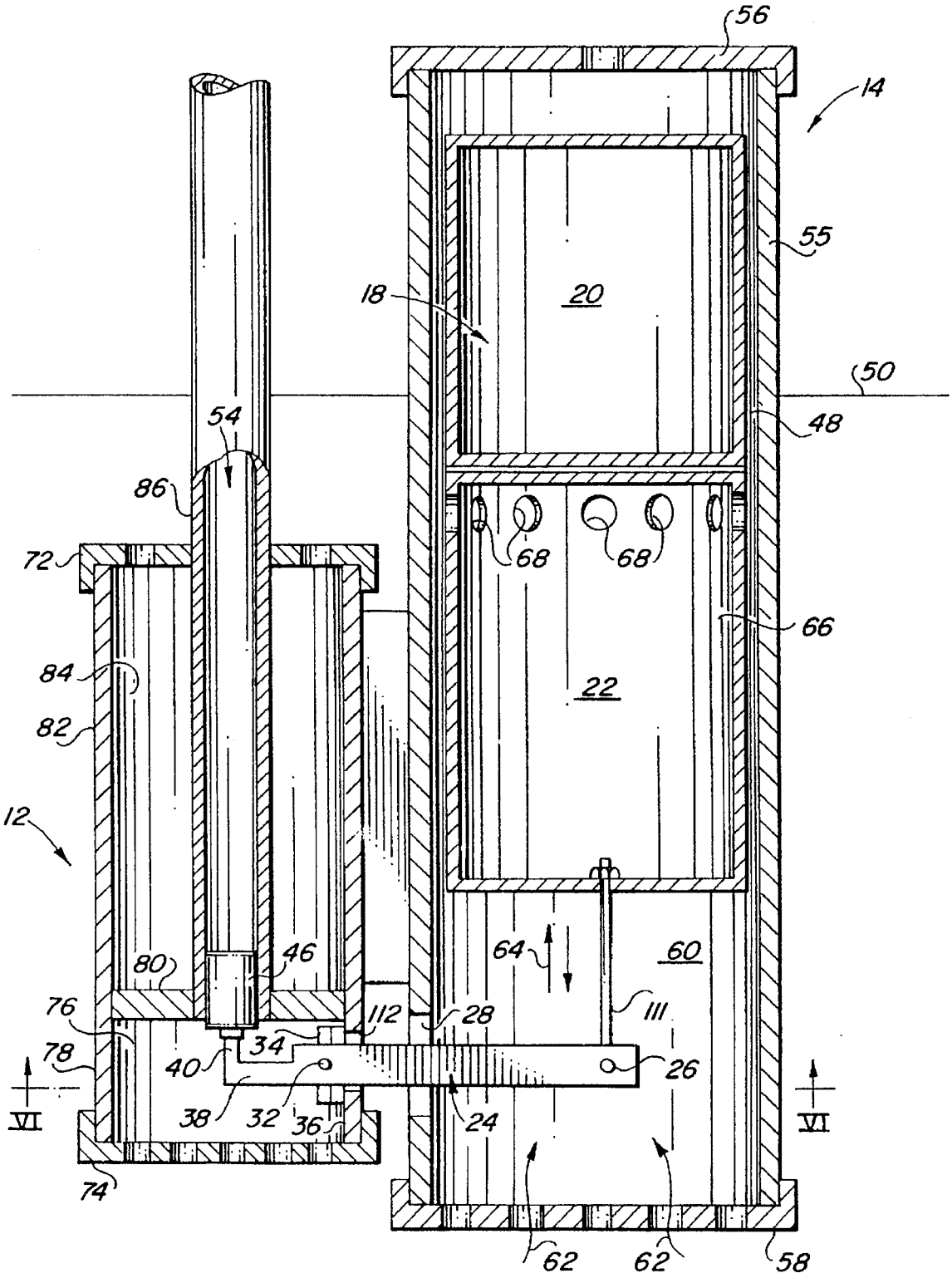
FIG. 3 is a partial cross-section view of float and valve housing portions of an embodiment of the present invention.
Figure 3A:
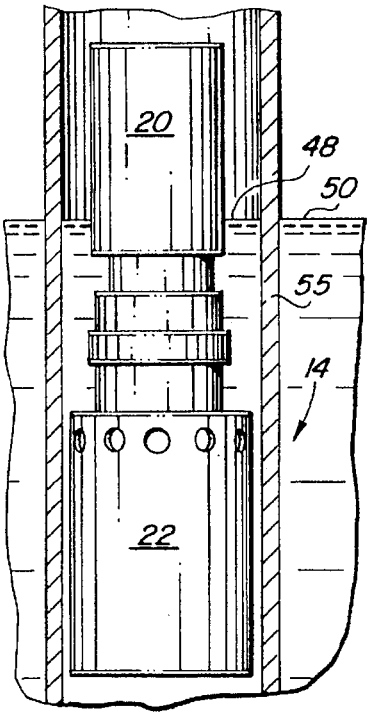
FIG. 3*a* is a partial cut away view of a float housing illustrating alternate float and ballast embodiments.

The preferred embodiment of the present invention is a water level control device 10 comprising two connected tubular housings, a valve housing 12 and a float assembly housing 14, as illustrated with reference to FIG. 1. The valve housing 12 serves as a support for a hose attachment connection pipe assembly 16, again as illustrated with reference to FIG. 1 and to FIG. 2. The float assembly housing 14 serves to house a float and ballast assembly 18 having a float 20 and ballast 22 below the float 20 for operation with a lever arm 24, as illustrated with reference to FIG. 3. The float and ballast assembly 18 is rotatably attached to a lever arm first end 26. The lever arm 24 passes through an opening 28 in the float assembly housing 14 and pivots about a fulcrum pin 32 attached to a fulcrum pin mount 34 attached to a valve housing lower portion inside wall 36. A lever arm second end 38 includes a valve pin 40 dimensioned for movement through a ball valve aperture 42 for displacing a ball 44 seated within a ball valve 46 as will be later described in more detail. The float 20 is airtight and serves to raise the lever arm first end 26 when buoyed by sufficient water level 48 within the float assembly housing 14. When a water level 50 in the pool 52 is lowered, the float 20 and lever arm first end 26 will also be lowered, raising the lever arm second end 38 and valve pin 40 which urges against the ball 44 pushing it away from its seated position, thus permitting water 53 to flow from a water supply 54 through the valve housing 12 and enter the pool 52 bringing the pool water level 50 to its desired level. At such time, the float 20 rises with the pool water level 50, as will be further described, and causes the valve pin 40 to retract and have the ball 44 return to its seated position, stopping flow through the ball valve 46. Detailed construction and operation of the water level control device 10 for a preferred embodiment of the present invention is now further described, with reference to FIG. 3.

The float assembly housing 14 has side walls 55, a vented top wall 56 and an apertured bottom wall 58, forming a float assembly housing chamber 60. The vented top wall 56 and apertured bottom wall 58 cause smooth pool water flow 62 into the chamber 60 causing the water level 48 within the chamber to accurately represent the pool water level 50. Further, the free pool water flow 62 through the apertured bottom wall 58 permits vertical movement 64 of the float 20 to be partially unaffected by wave motion at the pool water level 50. Such an arrangement acts to baffle or dampen the effects of pool waves. As will be described later within this section, the ballast 22 improves on this dampening effect to provide for smooth vertical movement 64 of the float 20, unaffected by wave motion at the pool level 50 and thus limit the hazardous on-and-off switching of the ball valve 46.

The chamber 60 has an inside dimension for receiving the float and ballast assembly 18 for the smooth vertical movement 64 of the assembly 18 within the chamber 60 in response to changes in the pool level water 50. Again as illustrated with reference to FIG. 3, a preferred embodiment of the present invention comprises tubular float assembly housing 14, airtight float 20, and ballast 22. Convenience and cost dictated the use of a cylindrical float assembly housing 14 for receiving cylindrical shape float 20 and ballast 22 elements.

The ballast 22 in the preferred embodiment is a generally cylindrical container having side walls defining a ballast cavity or chamber 66 which, in operation, is flooded with pool water entering the float assembly housing chamber 66. The flooded ballast 22 is connected to the float 20 thus permitting water captured within the ballast chamber 66 to provide a damping effect on the float 20 for further reducing float movement responsive to wave activity at the pool water level 50. Holes 68 are provided within ballast side walls 70 to aid in the flooding of the chamber 66. As illustrated with reference to FIG. 3, by dimensioning the ballast 22 to be closely received within the float assembly housing side walls 55, further damping due to wave activity at the pool water level 50 is accomplished. For providing adequate buoyancy within the float assembly housing 60, the airtight float 20 is dimensioned to provide sufficient water around the float 20 for unhampered buoyancy of the float 20.

Again with reference to FIGS. 1–3, the valve housing 12 is connected adjacent the float housing 14. The valve housing 12 has side walls 70, a vented cap 72 and an apertured bottom wall 74. In the preferred embodiment, an outlet chamber 76 is formed between a side wall lower portion 78, the apertured bottom wall 74, and a partition wall 80. This outlet chamber 76 receives water from the water supply 54 passing through the ball valve 46. The chamber 76 is in fluid communication with the pool 52 through the apertured bottom wall 74. A valve housing upper side wall portion 82, the partition wall 80, and the vented cap 72 form a second chamber 84 for the valve housing 12, which is flooded during operation of the device 10. This flooded second chamber 84 aids in providing additional stability to the device 10 during operation. By having water flow through the ball valve 46 into the outlet chamber 76, before flowing into the pool 832, turbulence around the ball valve 46 is contained within the outlet chamber 76 for smooth flow of water through the apertured bottom wall 74. Such an arrangement aids in minimizing pool water level wave activity, and thus provides for the smooth vertical movement 64 sought for the operation of the device 10.

As illustrated again with reference to FIG. 3, a water supply pipe 86 is adapted at one end for connection with the ball valve 46. As will be described later in further detail, and as illustrated with reference to FIGS. 1 and 2, the water supply pipe 86 is part of the pipe assembly 16. As illustrated with reference to FIGS. **4*a*–4*c*, the ball valve 46 has inlet 88, outlet 90, and side 92 walls forming a valve cavity 94. The outlet wall has the aperture 42, earlier described. The inlet wall 88 has an aperture 96, which is be sealed when the ball 44 is biased against the inlet wall 88 within the cavity 94. Similarly, the aperture 42 is sealed when the ball 44 is biased against the outlet wall 90. The valve inlet wall 88 is connected for fluid communication to the water supply pipe 86 for permitting water flow 98 through the valve cavity 94 during periods when the ball 44 is between the inlet wall 88 and outlet wall 90 in an unseated position, as will be further described. The ball 44 is dimensioned for freely moving within the cavity 94 responsive to pressure changes within the cavity 94, typically due to flow 53 from the water source 54 through the inlet wall aperture 96 or from the pool 52 through the outlet wall aperture 42**.

Figure 4A:
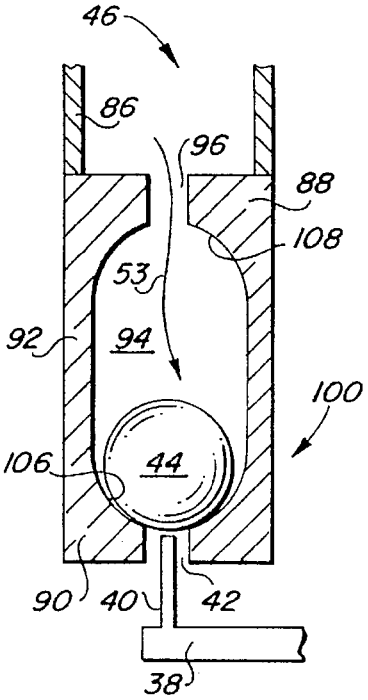
FIGS. 4*a*–4*c* are partial cross-section views of a ball valve of the present invention illustrating seated, unseated and anti-siphoning positions for a ball within the ball valve cavity.
Figure 4B:
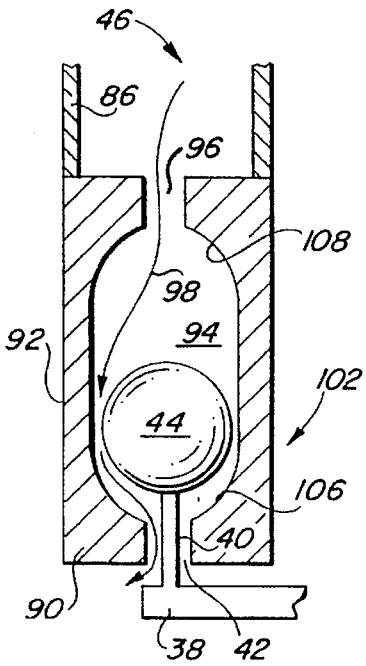
Figure 4C:
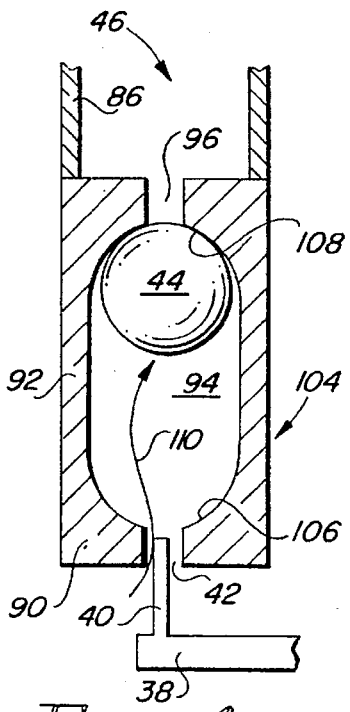

Again with reference to FIGS. **4*a*, 4*b* and 4*c*, the ball 44 is described and illustrated as having a ball first position 100, ball second position 102, and ball third position 104. With reference to FIG. 4*a*, the ball first position 100 includes the ball 44 seated against the ball valve outlet wall inside surface 106 wherein pressure from the supply or source water 53 passing into the cavity 94 biases the ball 44 against the outlet wall aperture 42 for sealing or closing off the aperture 42, thus preventing water flow through the outlet aperture 42. With reference to FIG. 4*b*, the ball second position 102 has the ball 44 displaced from the outlet wall inside cavity surface 106 permitting water flow 98 through the cavity 94 and through the outlet wall aperture 42 thus permitting, as earlier described, water flow into the outlet chamber 76, illustrated with reference to FIG. 3, and ultimately through the apertured bottom wall 74 into the pool 52. As earlier described, the displacement of the ball 44 in the second position 102 is caused by the valve pin 40 biasing against the ball 44 with sufficient force to overcome pressure from the source water flow 53. With reference to FIG. 4*c*, the ball third position 104 having the ball 44 biasing against the inlet wall cavity inside surface 108 results from flow 110 from the pool 52 through the outlet wall aperture 42. Such a condition is caused from siphoning from the pool toward the water supply 54. The ball third position 104 thus prevents siphoning from the pool 52 to the water supply 54, an object of the present invention. As illustrated with reference to FIGS. 5*a*–5*d*, ball valve 46 has a cylindrical cavity 94 for receiving a spherical ball 44 and is manufactured by joining an upper ball valve section 46*a* to a lower ball valve section 46*b* after placing the ball 44 within the cavity 94. The ball valve 46 has a cylindrical shape for convenient attachment to the water supply pipe 86 as described earlier with reference to FIG. 3**.

Figure 6:
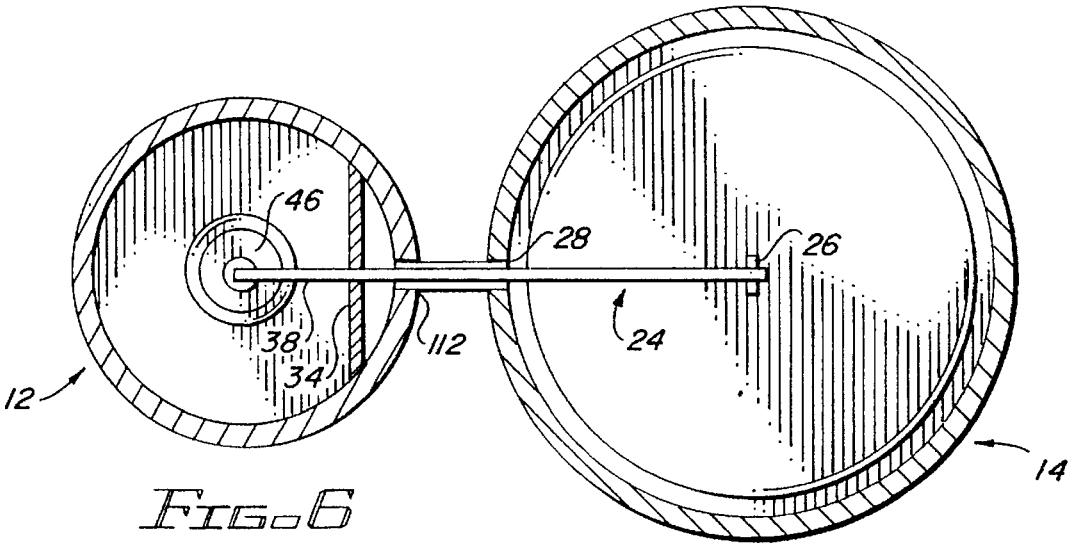
FIG. 6 is a partial cross-section view of the embodiment of FIG. 3 through plane designated as VI—VI.
Figure 7:
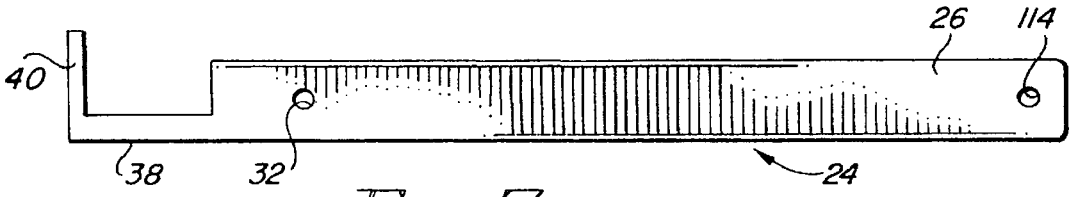
FIG. 7 is a side view of a lever arm on the embodiment of FIG. 3.

Again with reference to FIG. 3, the lever arm 24 has the first end 26 pivotally attached to the float and ballast assembly 18 using a connecting rod 111. The lever arm 24 is pivotal about the fulcrum pin 32 as earlier described. The lever arm second end 38 has the valve pin 40 extending upward for penetrating the ball valve outlet wall aperture 42, as earlier described. As illustrated with reference again to FIG. 3 and to FIG. 6, a cross-sectional view VI—VI of FIG. 3, the lever arm 24 passes through the opening 28 in the float assembly housing side wall 55 and through an opening 112 in the valve housing lower wall 36 for free movement and pivoting about the fulcrum pin 32. As illustrated with reference to FIG. 7, the preferred embodiment incorporates a 4-to-1 mechanical advantage between the float assembly rod connection 114 at the lever arm first end 26 about the fulcrum pin 32 to the valve pin 40. Such a mechanical advantage provides for smooth operation of the ball valve 46 in response to the vertical movement 64 caused by the float 20 buoyed by the water level 48 in response to changes in the pool water level 50, as earlier described. As earlier described, the valve pin 40 is dimensioned for freely passing through the ball valve outlet wall aperture 42 for displacing the ball 44 to the second position 102 in response to the lowering of the float 20 thus permitting the water flow 98 through the outlet wall aperture 42 for raising the pool water level 50 to the desired level. As the pool water level 50 reaches the desired level, the float 20 is buoyed upward, pulling the lever arm first end 26 upward, and thus lowering the lever arm second end 38 for pulling the valve pin 40 out of contact with the ball 44, thus returning the ball valve 46 to its first ball position 100, stopping flow into the pool 52. As described earlier, the preferred embodiment of the present invention positions the ball valve 46 at a lower portion of the valve housing 12. Such a position is not critical to the operation of the device 10. An important feature of the device 10 is the free movement of the ball 44 between extreme seated positions within the cavity 94 and free movement within the cavity 94.

Figure 8:
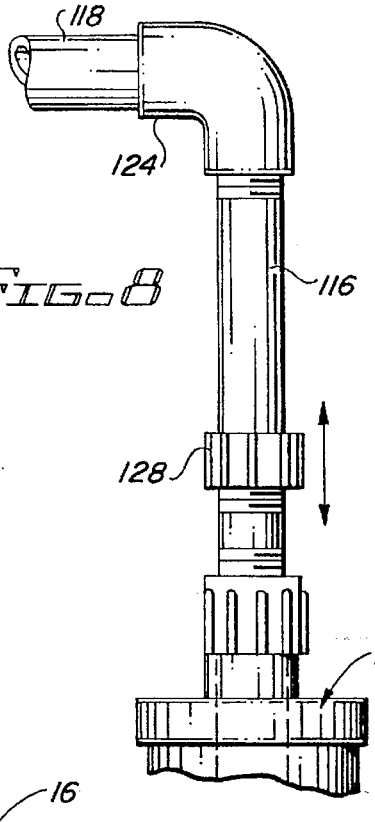
FIG. 8 is an elevation view illustrating a vertical portion of the embodiment of FIG. 1.
Figure 9:
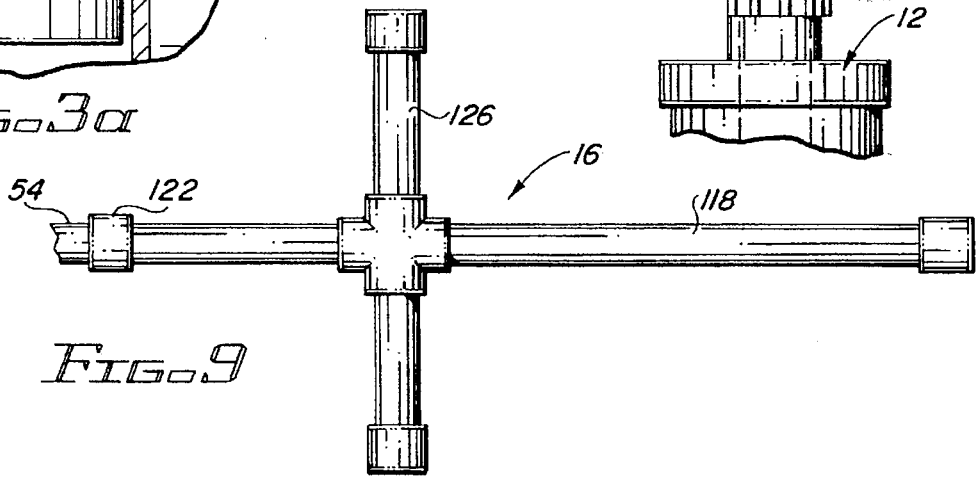
FIG. 9 is a top plan view illustrating a pool deck portion of the embodiment of FIG. 1.

As described again with reference to FIGS. 1 and 2, the device 10 comprises the pipe assembly 16 for positioning the float assembly housing 14 and thus the float 20 at the pool water level 50 desired for proper pool operation. The pipe assembly 16 further holds the valve housing 12 in a submerged location below the pool water level 50. In the preferred embodiment, the pipe assembly 16 comprises a tubular portion 116 extending vertically from the valve housing 12, as illustrated with reference to FIG. 1 and FIG. 8. The vertical portion 116 has a length for positioning the float assembly housing 14 at a level for buoying the float 20 at the desired pool water level 50. The pipe assembly 16 further has a horizontal tubular portion 118 for placement on a pool deck 120 adjacent the pool 52. The horizontal portion 118 has one end 122 adapted for connection with a garden hose (not shown). The horizontal portion forms a right angle 124 with the vertical portion 116. As illustrated again with reference to FIGS. 1 and 2, and to FIG. 9, the pipe assembly 16 further has an outrigger extending from the horizontal portion 118 for holding the vertical portion 116 within a vertical plane and thus the float assembly housing 14 in such a vertical position. In the preferred embodiment, the outrigger 126, as well as the horizontal 118 and vertical 116 portions of the pipe assembly 16, continuously have water from the water supply 54 therein. Such provides sufficient weight to stabilize the device 10 without affixing any portion of the device 10 to the pool structure. Further, as illustrated with reference to FIG. 8, the vertical portion 116, in an alternate embodiment, comprises an adjustable sleeve 128 for adjustment to the vertical tube portion dimension. In the preferred embodiment, a vertical tube portion 116 is selected to place the housings 12, 14 proximate a location to monitor pool water level 50. Adjustable portion 118 is then used to make minor adjustments to the length of the vertical tubular portion 116.

Figure 10:
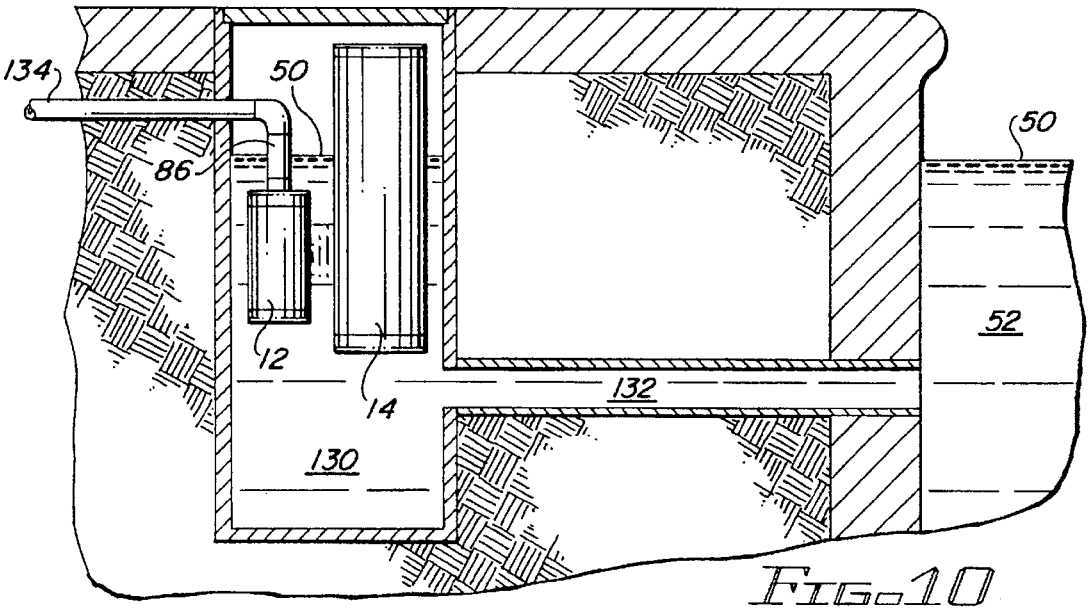
FIG. 10 is a partial cross-section view of an alternate installation of the present invention.
Figure 5A:
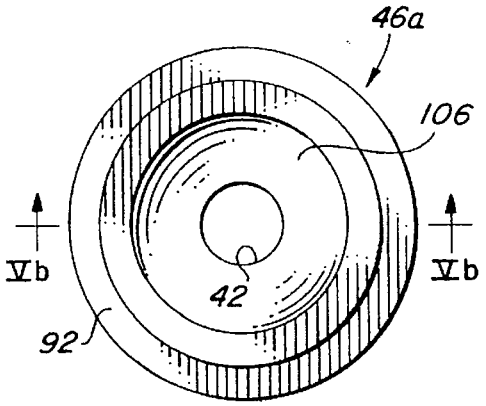
FIG. 5*a*–5*d* are plan and cross-section views of bottom and top portions, respectively, for an embodiment of the ball valve.
Figure 5C:
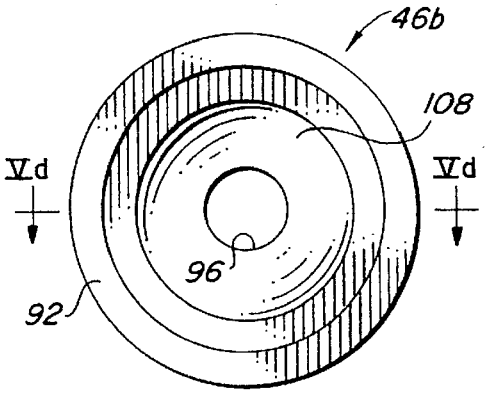
Figure 5B:
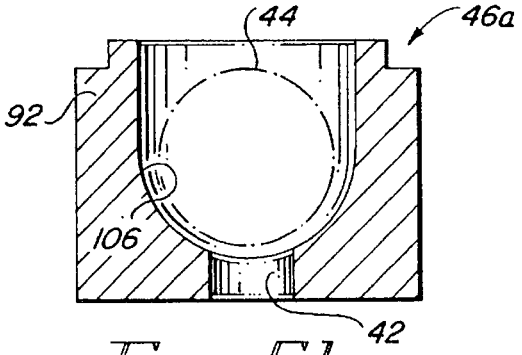
Figure 5D:
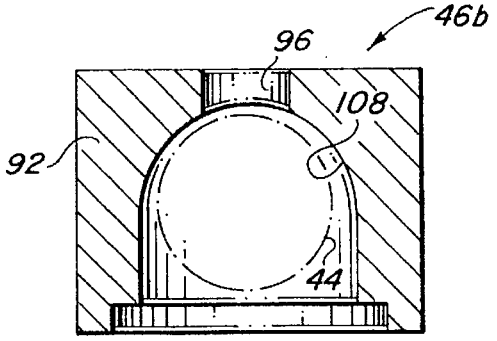

As illustrated with reference to FIG. 10, the water level control device as described is adaptable for use in a permanent installation. One such installation includes a well chamber 130 in fluid communication with the pool 52 through a conduit line 132 for providing the pool water level 50 within the well chamber 130. For such an installation, a dedicated water line 134 is placed in fluid communication with the water supply pipe 86, earlier described.

While specific embodiments of the invention have been described in detail hereinabove, it is to be understood that various modifications may be made from the specific details described herein without departing from the spirit and scope of the invention as set forth in the appended claims. Having now described the invention, the construction, the operation and use of preferred embodiments thereof, and the advantageous new and useful results obtained thereby, a new and useful constructions and reasonable mechanical equivalents thereof obvious to those skilled in the art are set forth in the appended claims.

What is claimed is:

1. A fluid flow control device comprising:

a hollow valve body having an inlet aperture, an outlet aperture, and a valve chamber connected in fluid communication between the inlet and outlet apertures;

a valve element positioned within the valve chamber and being moveable between an inlet closed and an outlet closed position, the valve element being movable to the inlet closed position in response to a reverse fluid flow from the outlet aperture toward the inlet aperture, the valve element moveable to the outlet closed position responsive to a forward fluid flow from the inlet aperture toward the outlet aperture;

forward flow enabling means positioned adjacent the outlet aperture of the valve body for displacing the valve element, the displacing means positioning the valve element in spaced relation from the outlet aperture to enable a continued forward fluid flow from the inlet aperture and through the outlet aperture while permitting the valve element to move to the inlet closed position responsive to a reverse fluid flow, said forward flow enabling means comprising:

a lever arm having distal and proximate ends separated by a fulcrum pin for pivoting the lever arm about the fulcrum pin;

a valve pin attached to the lever arm distal end, the valve pin dimensioned for movement into the valve chamber through the outlet aperture, the valve pin further having a length dimension for displacing the valve element away from contact with the outlet aperture; and a float connected to the lever arm proximal end, the float responsive to level changes within a reservoir wherein a fluid level below the desired level causes the float to lower thereby raising the valve pin thus displacing the valve element from the outlet aperture;

a generally hollow vessel connected to the float wherein fluid is captured within the vessel for providing a damping effect on the float thus reducing float movement responsive to fluid surface instabilities; and a housing having side walls for closely receiving the float and vessel combination therein, the housing further having a bottom apertured wall for permitting fluid to flow into the housing through the bottom wall while blocking fluid surface instabilities from direct contact with the float, thus further providing float dampening when responding to the surface instabilities.

2. The device as recited in claim 1, wherein the chamber is further defined by a cylindrical inside valve wall surface and hemispherical end wall surfaces, and wherein the valve element has a spherical shape for providing sealing contact with the inlet and outlet apertures.

3. A fluid level control device comprising:

an inlet pipe for communicating with a fluid supply, the inlet pipe having a proximal end adapted for fluid communication with the fluid supply and a distal end dimensioned for fluid communication with a ball valve;

a ball valve having a hollow valve body, an inlet aperture, an outlet aperture, and a valve chamber connected in fluid communication between the inlet and outlet apertures, the ball valve further having a ball positioned within the valve chamber and being moveable between an inlet closed and an outlet closed position, the ball being moveable to the inlet closed position in response to a reverse fluid flow from the outlet aperture toward the inlet aperture, the ball moveable to the outlet closed position responsive to a forward fluid flow from the inlet aperture toward the outlet aperture;

a lever arm having distal and proximate ends separated by a fulcrum pin for pivoting the lever arm about the fulcrum pin, the lever arm having a valve pin formed for extending into the outlet aperture for biasing against the ball, the valve pin having a length dimension sufficient for positioning the ball away from contact with the outlet aperture for permitting fluid flow through the outlet aperture;

a float pivotally connected to the lever arm proximal end, the float buoyed at a fluid surface level, the float responsive to fluid level changes within a reservoir wherein a level below the desired level causes the float to lower thereby lowering the lever arm proximal end and raising the valve pin in response to the lever arm pivoting about the fulcrum pin thus positioning the ball away from the outlet wall aperture for permitting fluid flow through the outlet aperture into the reservoir; and a hollow ballast vessel having a chamber for holding fluid therein, the vessel having a top portion attached to the float for movement coincident with the float while submerged below the float, the vessel further having a bottom portion for pivotal connection to the lever arm proximal end, the vessel providing a dampening of float oscillations resulting from wave action on the fluid surface proximate the float.

4. The device as recited in claim 3, further comprising a housing having a chamber dimensioned for receiving the float and vessel combination, the housing having an apertured bottom for allowing sufficient fluid to enter the housing chamber to maintain fluid level therein, the housing limiting the wave action on the fluid surface from directly affecting float operation.

5. The device as recited in claim 3, wherein the inlet pipe comprises a horizontal portion for positioning on a deck surface proximate the reservoir, the horizontal portion having the proximal end adapted for connection with a garden styled hose, the horizontal further having a stabilizing member for holding a vertical portion within a generally vertical plane, and a vertical portion having a length dimension for placing the fluid level control device within the reservoir at a depth within the fluid for operation in monitoring a desired water level.

6. A water level control device for maintaining a constant water level in a swimming pool, the device comprising:

a float assembly housing having side walls, a vented top wall and an apertured bottom wall forming a chamber, the chamber dimensioned for receiving a float and ballast assembly for vertical movement of the assembly within the chamber in response to pool water level changes, the vented top wall and apertured bottom wall permitting free flow of pool water to the chamber while limiting pool water surface wave effects on a water level within the chamber;

a float positioned within the chamber for vertically slidable movement in response to chamber water level changes;

a valve housing connected adjacent to the float housing, the valve housing having side, top, and an apertured bottom wall forming an outlet chamber for fluid communication with the pool while preventing turbulence within the pool proximate the float assembly, the top wall adapted for receiving a ball valve assembly;

a water supply pipe adapted at one end for fluid communication with a water supply and at a second end adapted for connection with a ball valve, the pipe second end in fluid communication with the valve housing outlet chamber;

a ball valve having a hollow value body, an inlet aperture, an outlet aperture, and a value chamber connected in fluid communication between the inlet and outlet apertures, the ball valve further having a ball positioned within the valve chamber and being moveable between an inlet closed and an outlet closed position, the ball being moveable to the inlet closed position in response to a reverse fluid flow from the outlet aperture toward the inlet aperture, the ball moveable to the outlet closed position responsive to a forward fluid flow from the inlet aperture toward the outlet aperture; and a lever arm having one end pivotally attached to the float assembly and a second end adjacent the ball valve, the lever arm pivotal about a fulcrum pin therebetween, the lever arm further having a valve pin extending from the arm second end, the valve pin dimensioned for passing through the valve outlet aperture for displacing the ball away from the outlet aperture in response to a lowering of the float thus permitting water flow through the outlet wall aperture for raising the pool level, the valve pin moveable out of the aperture in response to a raising float thus placing the ball in the inlet closed position for stopping water flow into the pool while the float is buoyed at a desired water level.

7. The device as recited in claim 6, wherein the float assembly comprises an airtight float portion buoyed proximate the water level and a ballast portion communicating with the air tight float portion for movement with the float portion, the ballast portion having a water flooded cavity for providing damping of float movements in response to level perturbations resulting from the pool water surface waves.

8. The device as recited in claim 7, wherein the ballast portion comprises an apertured wall for permitting free flow of pool water into the ballast portion cavity.

9. The device as recited in claim 6, wherein the water supply pipe comprises a pipe assembly having a tubular portion extending vertically, the vertical portion having a length dimension for positioning the float assembly at a level for buoying the float at a desired pool water level, the pipe assembly further having a horizontal tubular portion for placement on a pool deck adjacent the pool, the horizontal portion having one end adapted for fluid communication with a garden hose, the horizontal portion forming a right angle with the vertical portion at a second end, the pipe assembly further having an outrigger extending from the horizontal portion, the outrigger for holding the vertical portion and thus the float assembly housing in a generally vertical position.

10. The device as recited in claim 6, wherein the valve housing further comprises a second chamber positioned above the outlet chamber, the second chamber formed by an extended side wall, the top wall and an apertured cap, the apertured cap permitting pool water flooding of the second chamber, the second chamber positioning below the desired water level for limiting lateral movement of the valve chamber.

11. The device as recited in claim 6, wherein the ball valve chamber has a cylindrical inside wall surface and hemispherical end wall surfaces for operation with a generally spherical ball.

12. A water level control device for maintaining a constant water level in a swimming pool, the device comprising:

a tubular valve housing for supporting a valved hose attachment connection;

a tubular float housing connected adjacent and generally parallel to the first housing, the tubular housing for receiving a float for operation of a valve positioned within the valve housing, the float housing further having apertured wall portions for permitting pool water to flood the housing;

a tubular float assembly having an air tight float portion affixed atop a flooded ballast portion, the ballast portion positioned below the air tight float portion for dampening float assembly motion resulting from pool water surface wave motion, the float assembly dimensioned for vertically slidable movement within the tubular float housing, the float assembly buoyed by sufficient water level admitted through the float housing wall apertures;

a ball valve positioned at a lower extreme of the tubular valve housing, the ball valve having upper and lower valve seats for receiving a ball biased against the seat, the ball valve having a ball for free movement between the seats, the ball urged against the lower valve seat by water pressure from a water supply in fluid communication with the hose attachment connection, the ball being moveable to the upper seat in response to reverse water flow from the pool thus preventing water flow into the water supply; and a lever arm having one end pivotally attached to the float assembly and a second end adjacent the ball valve lower seat for biasing against the ball seated against the lower valve seat, the lever arm pivotal about a fulcrum pin therebetween, the lever arm one end lowered when the pool water level is lowered thus lowering the float assembly, and raising the second end, the second end moving the ball away from the lower valve seat thus permitting water from the water supply to flow into the pool for raising the pool water level, the pool water level raising to a desired level wherein the float rises thus raising the lever one end, thus lowering the lever second end for permitting the ball to seat within the lower valve seat thus stopping flow from the water supply into the pool.

13. The device as recited in claim 12, further comprising the tubular float assembly having a cylindrical shape for receiving cylindrical shape float and ballast portions, the cylindrical float portion having a diameter dimensioned less than a diameter dimension of the ballast portion, the ballast portion closely received within the float housing cylindrical side wall.

14. The device as recited in claim 12, wherein the ballast portion further comprises apertured wall portions for permitting free entrance of water therein.

15. The device as recited in claim 12, further comprising an outrigger assembly for positioning the housings in a generally vertical position at a desired level within the pool, the outrigger assembly having a tubular portion extending vertically, the vertical portion having a length dimension for positioning the float housing assembly at a level for buoying the float at a desired pool water level, the outrigger assembly further having a horizontal tubular portion for placement on a pool deck adjacent the pool, the horizontal portion having one end adapted for fluid communication with a garden hose, the horizontal portion forming a right angle with the vertical portion at a second end, the outrigger assembly further having a support member extending from the horizontal portion for holding the vertical portion and thus the float assembly housing in a generally vertical position.

16. The device as recited in claim 15, wherein the vertical portion is adjustable from a first position selected for one desired level control to alternate positions for a different desired level control position.

* * * * *